US006094848A

United States Patent [19]

Heath et al.

[11] Patent Number: 6,094,848

[45] Date of Patent: Aug. 1, 2000

[54] DISPLAY CHIP AND METHOD FOR DISPLAYING AN ARTICLE

[75] Inventors: Sam Heath, San Antonio, Tex.; Kim Marie Robinson, Columbus; Richard J. DeCamp, Gahanna, both of Ohio; Carlos Roberto Rios, Laredo, Tex.; Karen June Dixon, Columbus; Don Pierce, Van Buren, both of Ohio

[73] Assignee: R.G. Barry Corporation, Pickerington, Ohio

[21] Appl. No.: 09/175,666

[22] Filed: Oct. 20, 1998

[51] Int. Cl.[7] ..... G09F 3/00

[52] U.S. Cl. ..... 40/322; 223/85

[58] Field of Search ..... 40/322, 661.06, 40/653; 223/85

[56] References Cited

U.S. PATENT DOCUMENTS

| | | | |
|---|---|---|---|
| 1,710,296 | 4/1929 | Clark | 40/322 |
| 3,414,175 | 12/1968 | Brosk . | |
| 3,755,859 | 9/1973 | Solari . | |
| 5,005,741 | 4/1991 | Kolton et al. . | |
| 5,056,248 | 10/1991 | Blanchard . | |
| 5,381,938 | 1/1995 | Vasudeva | 40/322 X |
| 5,826,760 | 10/1998 | Kolton et al. . | |
| 5,857,597 | 1/1999 | Kolton . | |

FOREIGN PATENT DOCUMENTS

| | | | |
|---|---|---|---|
| 220827 | 8/1994 | United Kingdom | 40/322 |

*Primary Examiner*—Terry Lee Melius
*Assistant Examiner*—William L. Miller
*Attorney, Agent, or Firm*—Merchant & Gould P.C.

[57] ABSTRACT

A display chip and a method for displaying an article are provided. The display chip includes a display card and a display card and product holder. The display card is provided for displaying information. The display card and product holder is provided for receiving and holding the display card within a display card receiving area. The display card and product holder includes a hanger for supporting the display chip on a rail; a frame body including a display card receiving area for receiving the display card; a retaining arm which moves between an open position for allowing insertion and removal of the display card, and a closed position in attachment to the frame body for securing the display card within the display card receiving area; and a product attachment location for providing attachment of products to the display chip.

16 Claims, 3 Drawing Sheets

DISPLAY CHIP AND METHOD FOR DISPLAYING AN ARTICLE

FIELD OF THE INVENTION

The invention relates to a display chip and a method for displaying an article.

BACKGROUND OF THE INVENTION

Display chips are commonly used in association with products or articles in a retail market. Display chips generally provide at least brand identification information and are attached to retail articles which are on sale. Display chips often include a hanger which allows the display chip to hang from a rail. This in turn allows the display chip to suspend the retail article.

Display chips are commonly prepared for use with a particular retail product or article. That is, the display chip is manufactured with the desired brand information for a retail product or article, and then the display chip is attached to the product or article. As a result, a new display chip is prepared every time a product or article is sold under a new brand name, or when the product or article is sold in a country requiring another language on the display chip.

SUMMARY OF THE INVENTION

A display chip is provided according to the present invention. Display chips are commonly used with products or articles in a retail market and include at least brand identification information. The display chip according to the invention includes a display card and a display card and product holder. The display card includes display information. The display card and product holder is provided for receiving and holding the display card within a display card receiving area. The display card can be inserted into or removed from the display card receiving area. The display card and product holder includes a hanger for supporting the display chip on a rail; a frame body including a display card receiving area for receiving the display card; a retaining arm which moves between an open position for allowing insertion and removal of the display card, and a closed position in attachment to the frame body for securing the display card within the display card receiving area; and at product attachment location for providing attachment of product to the display chip.

The display card and product holder is preferably prepared from a single piece of engineering plastic. The retaining arm is preferably attached to the frame body and rotates about hinges which are formed from the same material as the frame body and the retaining arm.

A method for displaying an article is provided by the invention. The method includes steps of providing a display card and product holder having a display card receiving area, providing a display card within the display card receiving area, and attaching product to the display card and product holder. It should be appreciated that the step of attaching the product to the display card and product holder can precede the step of providing a display card within the display card receiving area.

The display card and product holder can be provided in either a closed position or an open position. When provided in a closed position, the retaining arm is attached to the frame body. When provided in an open position, the retaining arm is not attached to the frame body except at the hinge location. Accordingly, the display card can be placed within the display card receiving area when the display card and product holder is provided in either a closed position or an open position. When the display card and product holder is provided in a closed position, the display card can slide into the display care receiving area between the retaining arm and the frame body. When the display card and product holder is provided in an open position, the display card can be placed within the display card receiving area and the retaining arm can be placed over the edges of the display card.

DETAILED DESCRIPTION OF THE PREFERRED EMBODIMENT

Figure 1:
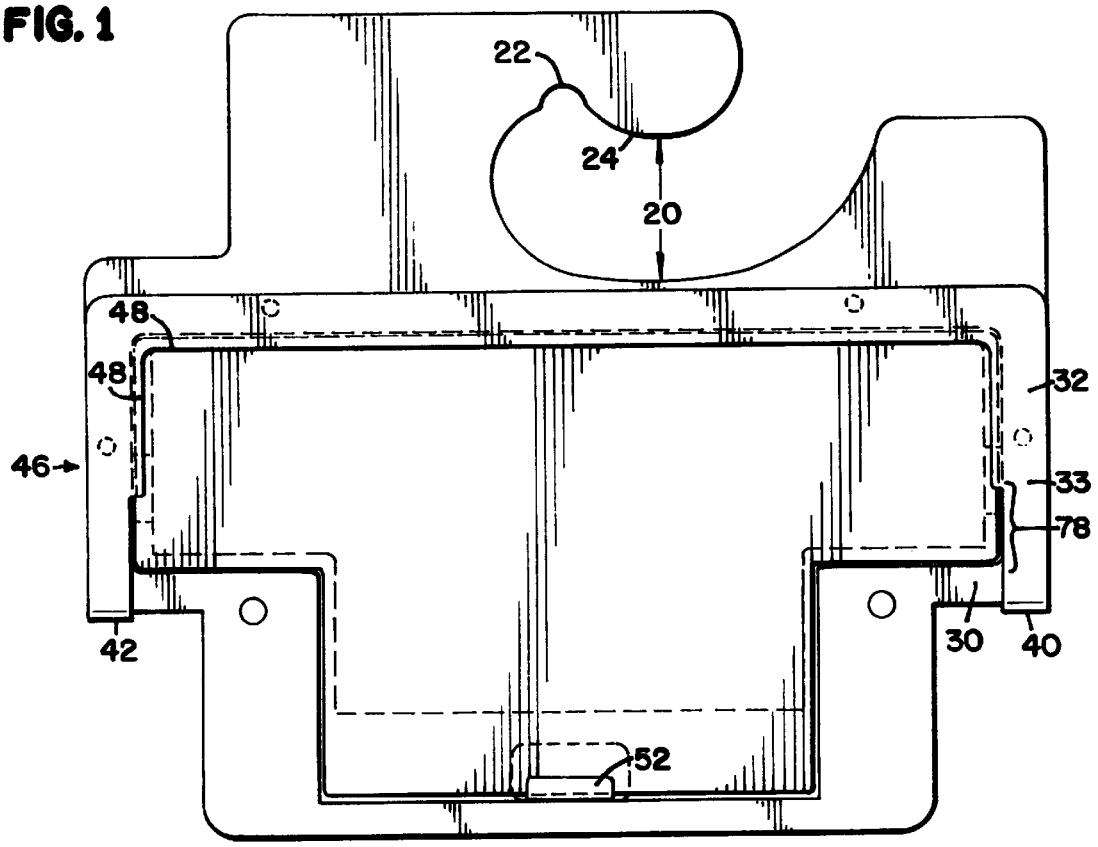
FIG. 1 is a front view of a display chip according to the present invention.
Figure 5:
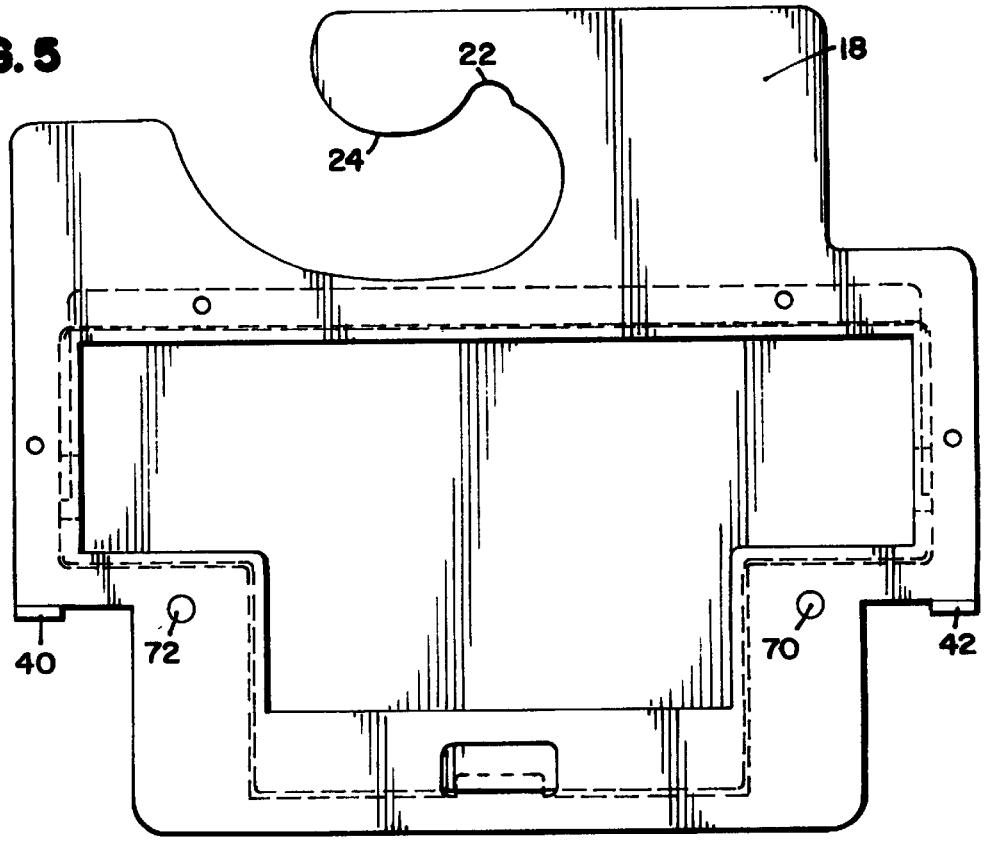
FIG. 5 is a rear view of the display chip of FIG. 1.
Figure 2:
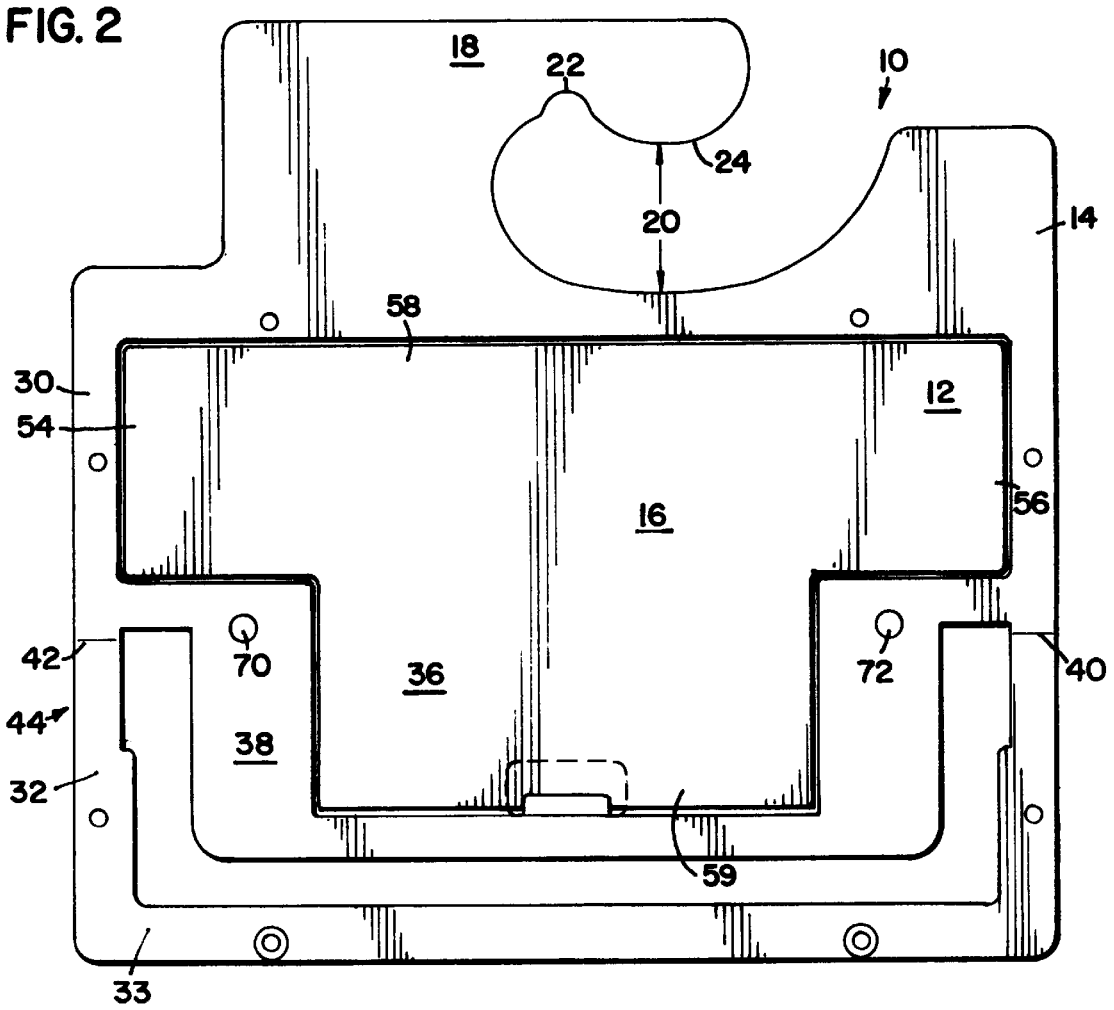
FIG. 2 is a front view of the display chip of FIG. 1 shown in an open position.
Figure 3:
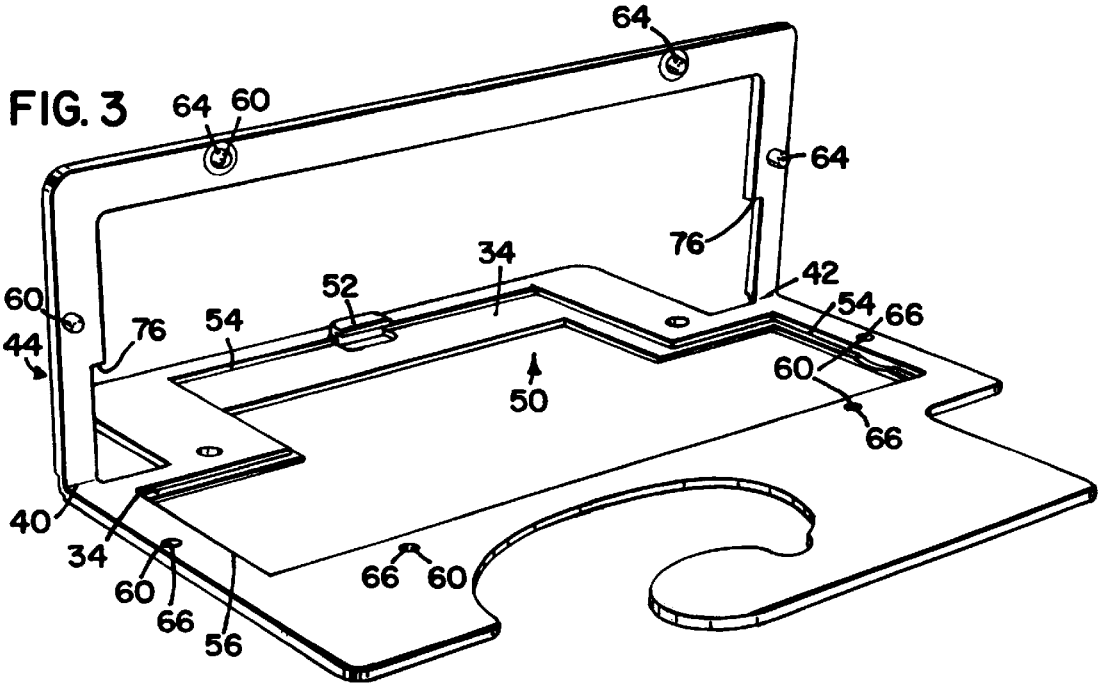
FIG. 3 is a perspective view of the display chip of FIG. 1 shown in an open position with the display card removed.

A display chip is a device typically used in the retail market and attaches to a retail product or article which is on sale, and provides display information about the product or article. Typically, an article which is on sale is attached to the display chip, and the display chip is hung from a display rack. Products or articles which are commonly found with display chips include slippers and gloves. The display information typically found on display chips includes at least one of brand identification information, sales information, handling or washing instructions, warranty information, manufacturer information, and sales or distributor information including address.

Now referring to FIGS. 1–5, a display chip according to the present invention is shown at reference numeral 10. The display chip 10 includes a display card 12 and a display card and product holder 14. The display card 12 includes display information 16 which is at least brand identification information. The display card 12 may additionally include information such as handling or washing instructions, warranty information, manufacturer information, or sales or distributor information. Preferably, the display card 12 is manufactured from a paper board material and includes marketing and design information. The display card 12 can be manufactured from other materials including, for example, plastic. The display card and product holder 14 is provided for holding the display card 12 in place, and for allowing attachment to an article for sale.

The display chip 10 can be referred to as a universal display chip. That is, the display chip can be used with various products or articles by selecting a particular display card for use with a particular product or article. Different display cards can be placed within the display card and product holder 14 to provide a display chip having information for a particular product or article, or in a different language.

The display card and product holder 14 includes a hanger 18 for attachment to a retail display rack. The hanger 18 includes an opening 20 for receiving the display rack bar, and a bar groove 22 for centering on the display rack bar. Additionally included is a lip 24 which helps prevent the display chip from sliding off the display rack bar.

The display card and product holder 14 includes a frame body 30 and a retaining arm 32. The frame body 30 includes a recessed perimeter 34 for receiving the display card 12. The recessed perimeter preferably has a depth d which is roughly equivalent to the thickness of the display card 12. Accordingly, the front surface 36 of the display card is preferably roughly flush with the front surface 38 of the frame body 30.

The retaining arm 32 is provided for retaining the display card 12 in place. The retaining arm 32 is preferably a rotatable arm 33 attached to the frame body at hinge locations 40 and 42. Preferably, the hinges are provided by a flexible material which allows the rotatable arm 33 to rotate between an open position 44 and a closed position 46. When the retaining arm 32 is provided in the closed position 46, an edge 48 extends over a portion of the display card 12 to hold it within the display card receiving area 50.

A clip 52 is provided along the lower edge 54 of the recessed perimeter 34. The clip 52 is provided for preventing the display card 12 from falling out of the display card receiving area 50. The retaining arm 32 is provided against the side edges 54 and 56 and the top edge 58 of the display card 12 while the clip 52 is provided against the lower edge 59 of the display card 12. Accordingly, the display card 12 is held in place in the display card receiving area 50. Furthermore, the display card 12 is easily removable by pulling the retaining arm 33 from the closed position 46 to the open position 44. Alternatively, the display card 12 and/or the frame body 30 can be flexed so that the display card 12 pops out of the clip 52. The display card 12 can then slide out of the display card receiving area 50. This is demonstrated in FIG. 4. Similarly, the display card 12 can be introduced into the display card receiving area 50 when the display card and product holder 14 is provided in the closed position 46 by sliding the display card 12 between the frame body 30 and the retaining arm 32, and then flexing the card and/or frame so that the card fits within the clip 52. As a result, various display cards can be conveniently swapped out of the display card and product holder 14.

A fastener 60 is provided for fastening the retaining arm 32 to the frame body 30. As shown, the fastener 60 includes a male/female fastening arrangement including protrusions 64 provided on the retaining arm 32 engage openings 66 on the frame body 30. The fit between the protrusions 64 and the openings 66 can be characterized as an interference fit which allows the retaining arm 32 to snap onto the frame body 30. The fastening arrangement is preferably refastenable. This means that once the retaining arm 32 is snapped onto the frame body 30, it can be pulled away and later reattached.

The frame body 30 includes areas 70 and 72 for attaching to a retail product or article. In general, a line which is attached to the product or article is threaded through the openings 70 and 72.

The display card and product holder 14 is preferably manufactured from a polymeric material or conventional engineering plastic. A preferred material which can be used to manufacture the display card and product holder 14 by injection molding includes polyethylene. Accordingly, the entire display card and product holder 14 can be injection molded as a single piece, continuous molded article. While the retaining arm 32 can be provided as a separate component from the frame body 30, it is convenient to have both the retaining arm 32 and the frame body 30 connected at the hinges 40 and 42. The hinges 40 and 42 should be sufficiently flexible to allow the retaining arm 32 to rotate. In the case of most engineering plastics, this will relate to a thinning of the material at the hinges 40 and 42 to provide ease of rotation of the retaining arm 32. It is advantageous to provide the display card and product holder 14 as a single construction, at least for the convenience of keeping the two components together.

Figure 4:
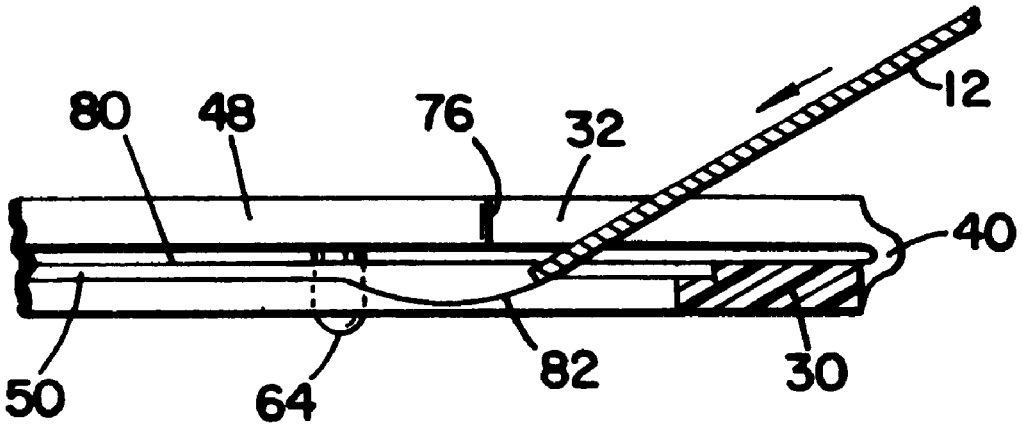
FIG. 4 is a sectional view of the display chip of FIG. 1 where the display card is partially inserted into the display card and product holder.

The display card 12 can be placed within the display card and product holder 14 by providing the display card and product holder in an open position 44, placing the display card 12 within the display card receiving area 50, then snapping the retaining arm 32 onto the frame body 30. Alternatively, the display card 12 can be inserted into the display card and product holder 14 provided in a closed position 46. That is, while retaining arm 32 is attached to the frame body 30. As shown in FIG. 4, the display card 12 can be slipped into the display card receiving area 50. The edge 48 of the retaining arm 32 which extends over the display card 12 preferably ends at a stop 76 along the retaining arm 32 to provide a gap 78. The gap 78 allows one to slip the display card within the channel 80 formed by the retaining arm 32 and the frame 30. A recessed area 82 is preferably provided in the display card receiving area 50 near the location 76 in order to provide a larger target area for receiving the display card within the channel 80. Once the display card 12 is inserted within the channel 80, the display card 12 and/or the display card and product holder 14 can be flexed so that the lower edge 59 slips within the clip 52. According to this method, display card and product holders can be provided in a closed position and attached to a product or article for sale. At a later time, the display card can be inserted into the display card and product holder.

While the invention is described in the context of a preferred embodiment, it should be appreciated that the invention is not limited by the preferred embodiment, but includes various embodiments within the scope of the claims.

We claim:

1. A display chip comprising:

a display card including display information; and a display card and product holder for receiving and holding said display card within a display card receiving area, said display card and product holder comprising:

a hanger for supporting said display chip on a rail;

a frame body including said display card receiving area for receiving said display card and a clip along a lower edge of the display card receiving area for retaining a lower edge of the display card the display card receiving area including a recessed surface for receiving the display card;

a retaining arm which moves between an open position for allowing insertion and removal of said display card, and a closed position in attachment to said frame body for securing said display card within the display card receiving area; and product attachment location for providing attachment of product to said display chip.

2. A display chip according to claim 1, wherein said retaining arm comprises a rotatable arm which rotates about at least one hinge.

3. A display chip according to claim 1, wherein said retaining arm snap fastens to said frame body.

4. A display chip according to claim 1, wherein said product attachment location comprises holes for receiving product attachment lines.

5. A display chip according to claim 1, wherein said display card and product holder is provided as a continuous plastic construction.

6. A display chip according to claim 1, wherein said display card and product holder is formed by injection molding.

7. A display chip according to claim 1, wherein said retaining arm includes protrusions and said frame body includes openings for receiving said protrusions.

8. A method for displaying an article comprising steps of:

(a) providing a display card and product holder for receiving and holding a display card including display information within a display card receiving area, said display card and product holder comprising:

a hanger for supporting said display card and product holder on a rail;

a frame body including the display card receiving area for receiving said display card and a clip along a lower edge of the display card receiving area for retaining a lower edge of the display card, the display card receiving area including a recessed surface for receiving the display card;

a retaining arm which is movable between an open position and a closed position, said retaining arm provided in the open position for allowing insertion of the display card, said retaining arm including a fastening arrangement for fastening to said frame body to provide said retaining arm in the closed position; and, product attachment location for providing attachment of product to said display card and product holder;

(b) providing the display card within the display card receiving area, and providing said retaining arm in the closed position; and, (c) attaching the product to said display card and product holder at said product attachment location.

9. A method for displaying an article according to claim 8, wherein said step of providing the display card within the display card receiving area comprises:

(a) providing the display card and product holder in the open position;

(b) placing the display card within the display card receiving area; and (c) fastening the retaining arm to the frame body to provide the display card and product holder in the closed position.

10. A method for displaying an article according to claim 8, wherein said step of providing said display card within the display card receiving area comprises:

(a) providing the display card and product holder in the closed position wherein the retaining arm is fastened to the frame body; and (b) sliding the display card between the retaining arm and the frame body.

11. A method for displaying an article according to claim 8, wherein said retaining arm comprises a rotatable arm which rotates about at least one hinge.

12. A method for displaying an article according to claim 8, wherein said retaining arm snap fastens to said frame body.

13. A method for displaying an article according to claim 8, wherein said product attachment location comprises holes for receiving product attachment lines.

14. A method for displaying an article according to claim 8, wherein said display card and product holder is provided as a continuous plastic construction.

15. A method for displaying an article according to claim 8, wherein said display card and product holder is formed by injection molding.

16. A method for displaying an article according to claim 8, wherein said retaining arm includes protrusions and said frame body includes openings for receiving said protrusions.

* * * * *